US005215295A

United States Patent [19]

Hoover

[11] Patent Number: 5,215,295

[45] Date of Patent: Jun. 1, 1993

[54] ENCLOSED ROTATABLE HEAD POWER CLAMP

[75] Inventor: Harold D. Hoover, Sterling Heights, Mich.

[73] Assignee: Delaware Capital Formation, Wilmington, Del.

[21] Appl. No.: 905,521

[22] Filed: Jun. 29, 1992

[51] Int. Cl.[5] ..... B23Q 3/08

[52] U.S. Cl. ..... 269/32; 269/31

[58] Field of Search ..... 269/32, 27, 77-78, 269/69, 71, 237-239

[56] References Cited

U.S. PATENT DOCUMENTS

| | | | |
|---|---|---|---|
| 3,371,923 | 3/1968 | Blatt | 269/32 |
| 4,494,739 | 1/1985 | Valentine | 269/32 |
| 5,118,088 | 6/1992 | Sawdon | 269/32 |

*Primary Examiner*—Robert C. Watson

*Attorney, Agent, or Firm*—Lloyd M. Forster

[57] ABSTRACT

Enclosed rotatable head power clamp has an adapter mounted on a base surface between a power cylinder and a clamp head with an actuating piston rod extending through the adapter guided by rollers in tracks formed in bifurcated hollow side plates completely enclosing the actuating linkage for a pivoted clamp arm. The clamp head connection to the adapter can be adjustable indexed to any of eight angular operative positions about the axis of the piston rod.

4 Claims, 4 Drawing Sheets

ENCLOSED ROTATABLE HEAD POWER CLAMP

BACKGROUND OF THE INVENTION

Industrial power clamps are adapted for mounting on a base with a power actuated clamp arm positioned to secure a production workpiece or similar object in an industrial environment. Linkage for actuating the clamp arm, unless enclosed, may be exposed to dust, dirt, abrasive particles, or the like which may cause undue wear and malfunction.

Provisions for covering the linkage have been employed such as disclosed in U.S. Pat. Nos. 4,637,597 and 5,064,177. A more complete sealing against particle intrusion has been accomplished by provision of a pivoted clamp arm actuated by internal linkage completely enclosed in the housing so that only a rotary shaft passing through a protective bushing extends between the completely enclosed linkage and an exposed exterior clamp arm. Such a construction has been commercially available from Tunkers GMBH Ratingan, Germany as disclosed in catalog sheet Model No. PK550K; in German Patent No. 2,555,207; and U.S. Pat. No. 4,905,973.

BRIEF DESCRIPTION OF THE PRESENT INVENTION

Such pivoted clamp arm with actuating shaft extending between a fully enclosed linkage housing and the exposed clamp arm is employed wherein the end of the actuating shaft is provided with a polygon configuration matching a female polygon socket for the clamp arm which may be adjusted to a plurality of angular relationships relative to the base of the clamp. In addition, the clamp head including the actuating linkage is rotatably secured on the clamp mounting adapter for adjustable angular positioning about the axis of the piston rod.

By this means, the combination of angular adjustment of the clamp arm about its pivotal axis, extending transverse to the axis of the piston rod, together with angular adjustment of the actuating head about the axis of the piston rod, accommodates a versatile employment of the clamp to engage any of a wide variety of work engagement surfaces having different orientation.

DETAILED DESCRIPTION OF PREFERRED EMBODIMENT

Figure 1:
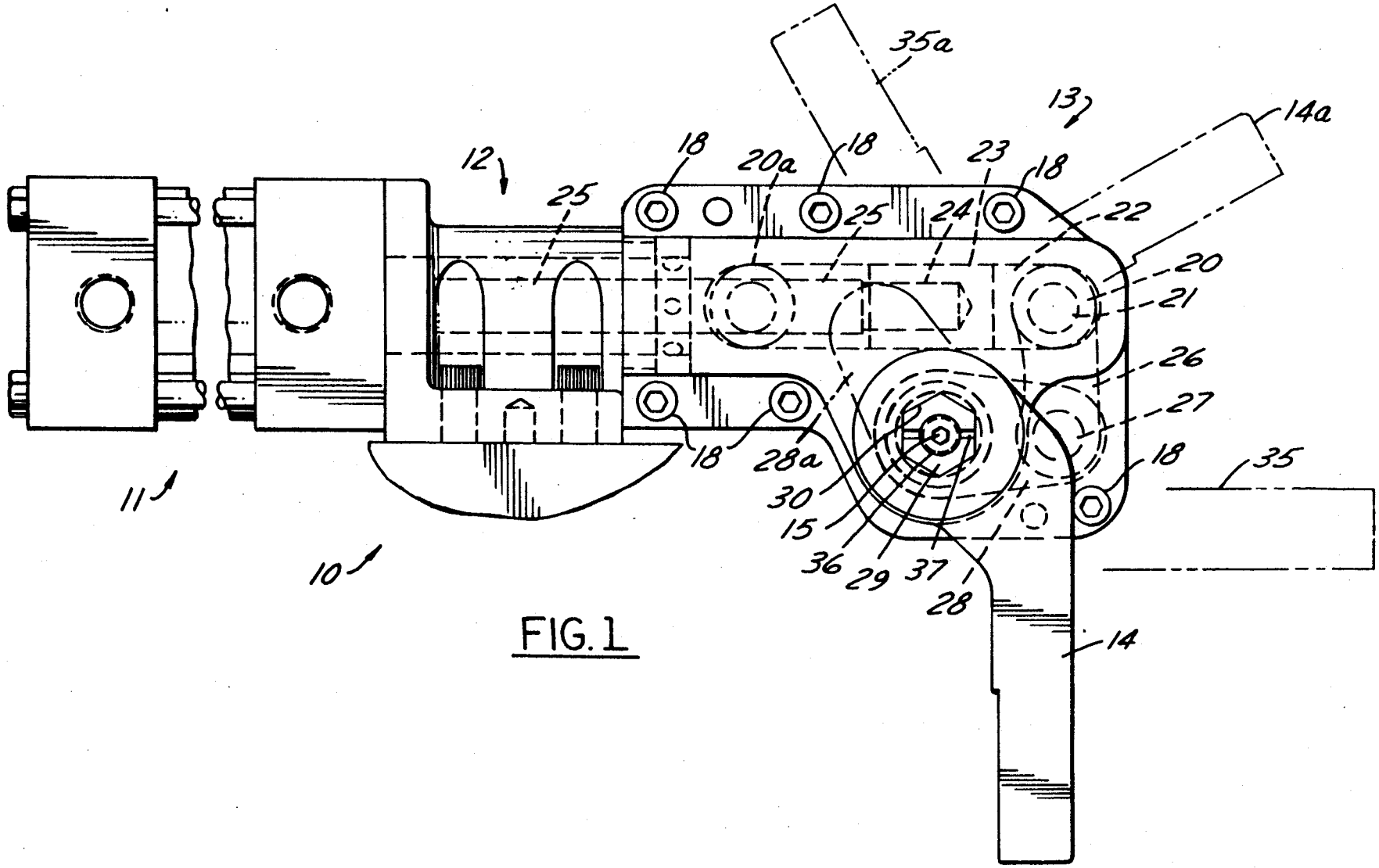
FIG. 1 is a side elevation of the power clamp of the present invention.
Figure 2:
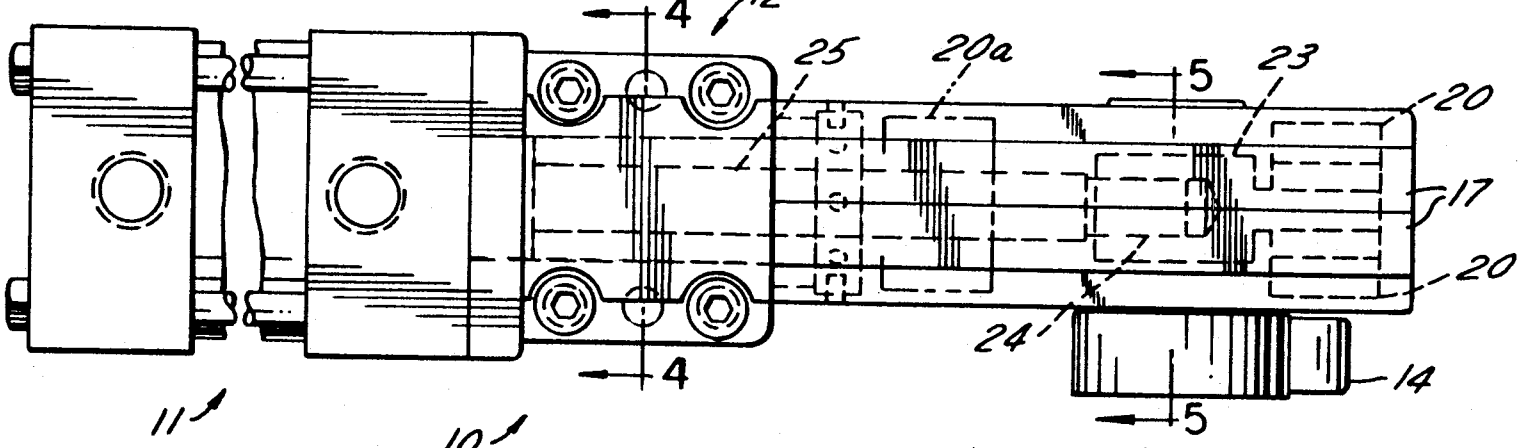
FIG. 2 is a plan view of the power clamp.
Figure 5:
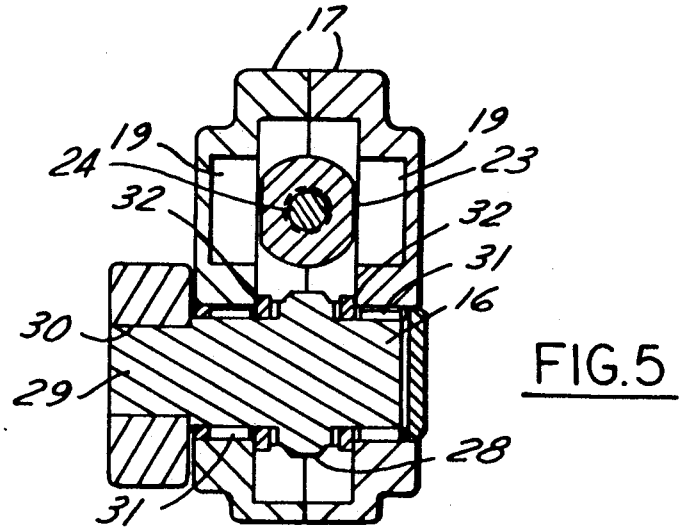
FIG. 5 is a sectional view taken along the line 5—5 of FIG. 2.

With reference to FIG. 1, power clamp assembly 10 comprises power cylinder 11, mounting adapter 12, and clamp head 13 having clamp arm 14, pivotally mounted at 15 on drive shaft 16 as best shown in sectional view of FIG. 5.

Figure 4:
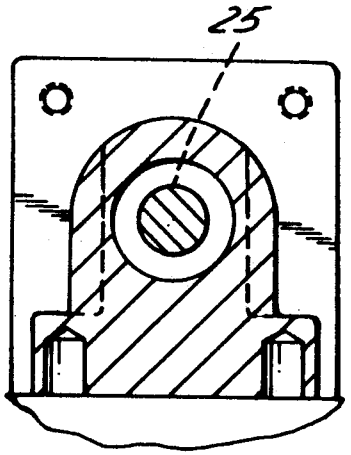
FIG. 4 is a sectional view taken along the line 4—4 of FIG. 2.
Figure 3:
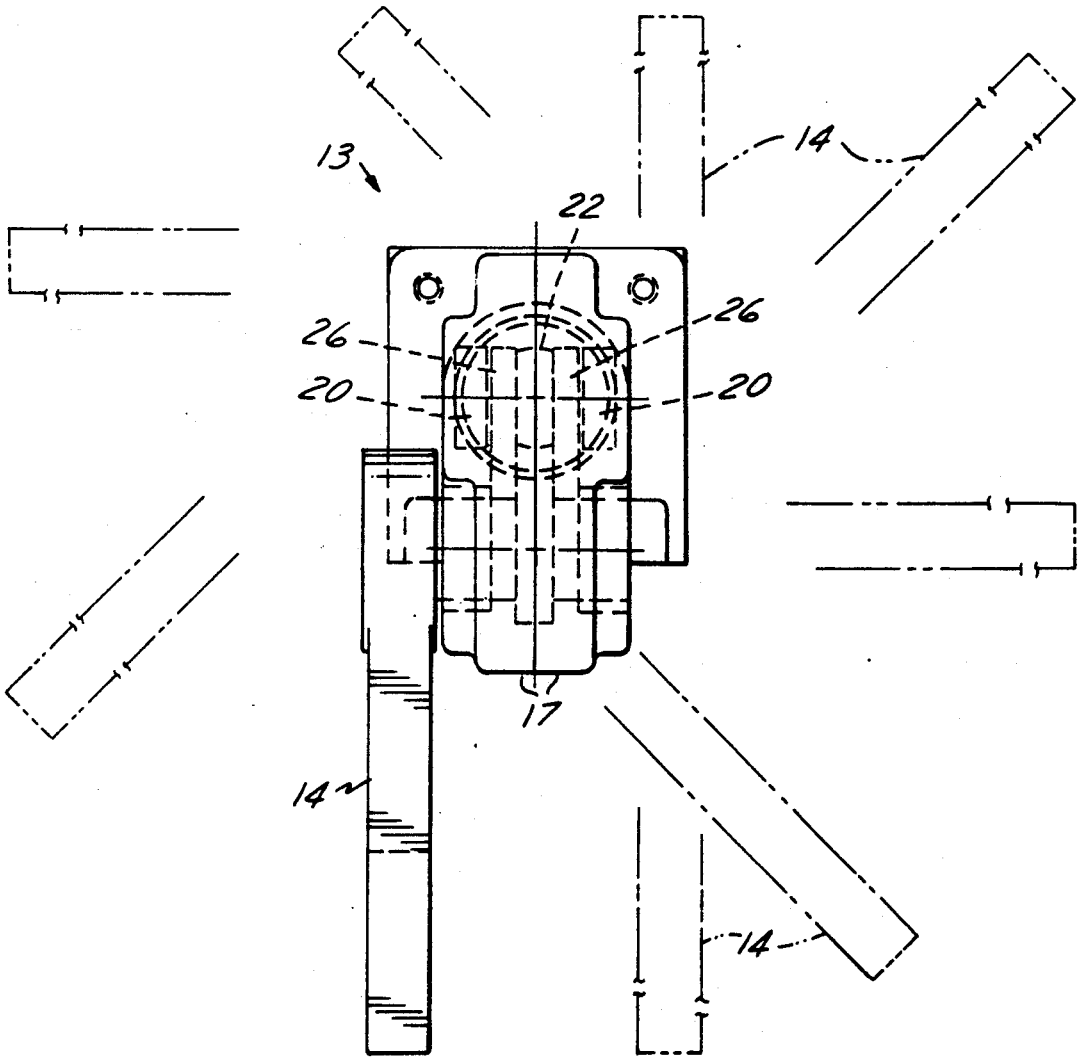
FIG. 3 is an end view of the power clamp.
Figure 6:
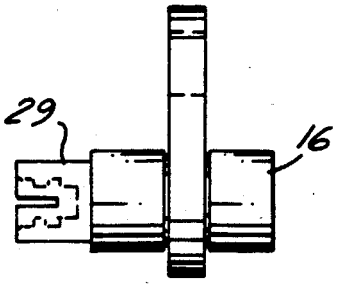
FIG. 6 is a side elevation of the drive shaft per se with bellcrank extension.

Clamp head 13 includes bifurcated housing halves 17 bolted together at 18 including guide tracks 19 for a pair of rollers 20 pinned at 21 to central tongue 22 projecting from annular adapter 23 threaded onto end 24 of piston rod 25 extending through mounting adapter 12, as shown in FIG. 4. A pair of actuating links 26 extending between track rollers 20 and tongue 22 are also pinned and actuated at 21 with pivotal connection at 27 to bellcrank extension 28 integrally formed on drive shaft 16 having hex socket end 29 engaging socket hole 30 in clamp arm 14.

As best shown in FIG. 5, drive shaft 16 is supported by needle bearings 31 seated in side plates 17 with thrust bearings 32 locating bellcrank 28 and drive shaft 16 transversely between side plates 17.

Actuation of clamp arm 14 to clamping position shown in full line is effected by advancing piston rod 25 and tongue 22 to the extremity position shown causing link 26 to actuate bellcrank 28 and drive shaft 16 to the clamping position of clamp arm 14. Retraction of piston rod 25 withdraws tongue 22, link 26 and bellcrank 28 to the retracted position of rollers 20 shown at **20*a* and bellcrank extension 28 to the retracted position 28*a*, thereby opening arm 14 to a 120° max arm opening shown at 14*a*. Clamp arm 14 shown as a 90° arm may be optionally replaced by 180° arm shown at 35 retractable to a 120° max arm opening shown at 35*a*. Either of such arms may be indexed on hex end 29 of drive shaft 16 to any of six positions by loosening pipe threaded screw 36 from hex end 29, which is split at 37 for a slip fit engagement with hex socket in clamp arm 14 and upon indexing the clamp arm reinsert and tighten screw 36** to tighten the hex end into rigid drive engagement.

Figure 8:
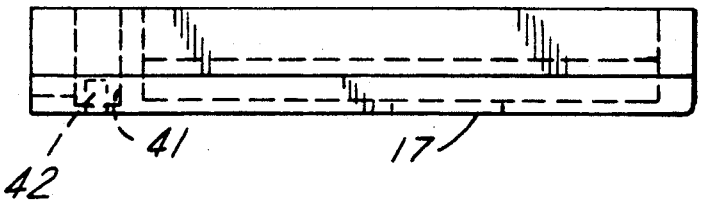
FIG. 8 is a plan view of the side plate illustrated in FIG. 7.
Figure 7:
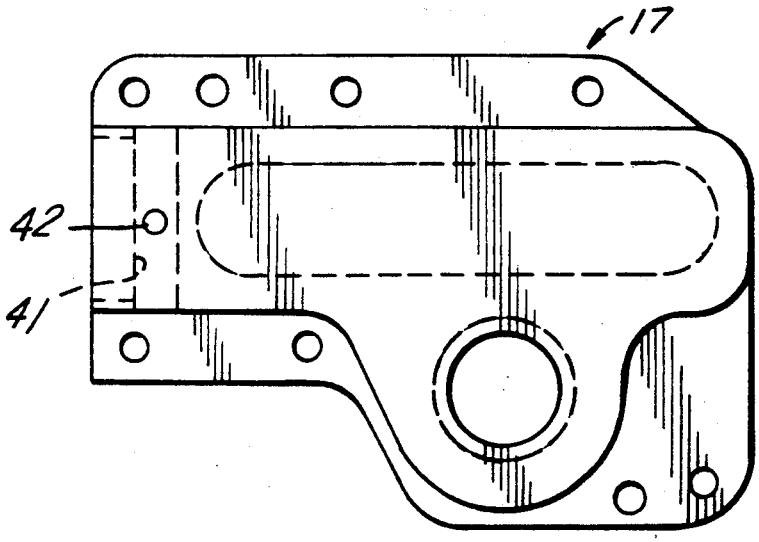
FIG. 7 is a side elevation of one of the bifurcated housing plates per se, as shown in the assembly of FIG. 1.
Figure 9:
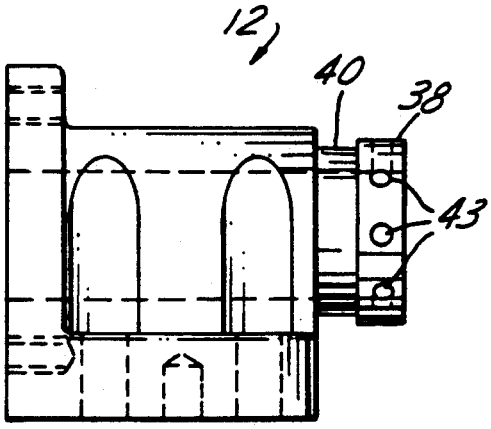
FIG. 9 is a side elevation of the mounting adapter per se illustrated in the assembly of FIG. 1.
Figure 10:
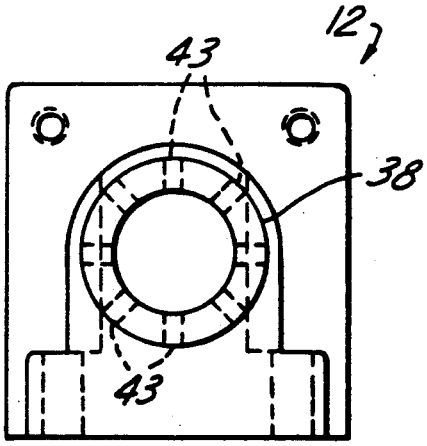
FIG. 10 is an end view of the adapter illustrated in FIG. 9.

With reference to FIGS. 7, 8, 9 and 10, means for indexing head 13 about the axis of piston rod 20, to any of eight optional positions is illustrated. In FIG. 9, illustrating mounting adapter 12 per se, integral annular collar 38 projecting from end face 39 is necked down at 40 to provide an annular flange for rigid engagement by semi-cylindrical grooves 41, machined in respective side plates 17 as shown in FIGS. 8 and 9, to provide an interference fit with collar 38 secured by tightening the respective six bolts 18 for connecting the side plates in close sealing engagement. Dowel pin 42 pressed into each side plate engages with slip fit one of eight holes 43 provided in collar 38 to locate one of eight optional positions for operation of the clamp arm.

From the foregoing description, it will be understood that the six optional positions for the clamp arm indexable about the axis of drive shaft 16, together with the eight optional positions for indexing head 13 about the piston rod axis provide forty-eight distinct alternative operating positions for the clamp arm; and an additional optional forty-eight positions can be obtained with the optional 180° clamp arm illustrated at 35. A further equal number of optional positions may be realized by reversing the installation of drive shaft 16 to convert from a right to a left-hand arm made possible by the otherwise symmetrical configuration of the clamp components.

A further dual arm option may be provided by duplicating the hex end extension on each side of drive shaft with the addition of a second clamp arm.

Through the use of an O-ring seal 44 and disc seal 45, together with sealing engagement of bifurcated side plates 17, a completely sealed enclosure for the operating linkage has been effected which assures long trouble-free life of the clamp assembly.

I claim:

1. Power clamp assembly comprising power cylinder with linear piston rod projecting from one end, adapter body with means for attachment to a mounting base surface, a clamp head with enclosed guide means for said projecting rod, a pivoted clamp arm, and linkage means actuated by said piston rod for actuating said pivoted clamp arm, characterized by said adapter body being secured to one end of said power cylinder with through passage therebetween for said piston rod, means for securing said clamp head to said adapter body, rotatably adjustable about the axis of the piston rod, in any of a plurality of angularly spaced positions, and wherein said clamp head is rotatably secured to said adapter body by means of an integral annular collar extension from said adapter body engaged by cylindrical grooves in a bifurcated pair of side plates providing a clamp head housing.

2. Clamp assembly of claim 1 including a plurality of radial locating holes in said collar, and a locating pin projecting into the cylindrical groove of each side plate to engage one of said optional locating holes.

3. Power clamp assembly of claim 3 including interference fit of said collar extension within said cylindrical grooves, secured to assembly by a plurality of bolts connecting said side plates.

4. Power clamp assembly of claim 1 wherein said clamp head includes a pair of bifurcated hollow side plates providing a complete enclosure for said piston rod and linkage with a drive shaft for said clamp arm extending through a side plate.

* * * * *